United States Patent [19]

Mitchell

[11] Patent Number: 5,016,858

[45] Date of Patent: May 21, 1991

[54] HYDRAULIC LIFT MECHANISM FOR CAMPER SHELLS

[76] Inventor: William D. Mitchell, 10655 Morada Dr., Orange, Calif. 92669

[21] Appl. No.: 301,236

[22] Filed: Jan. 24, 1989

[51] Int. Cl.[5] ..... B66F 7/26

[52] U.S. Cl. ..... 254/45; 254/122; 254/124

[58] Field of Search ..... 254/45, 122, 124, 93 VA, 254/89 H, 2 R, 2 B, 2 C

[56] References Cited

U.S. PATENT DOCUMENTS

| | | | |
|---|---|---|---|
| 2,899,172 | 8/1959 | Cresci | 254/122 |
| 3,164,371 | 1/1965 | Royle | 254/45 |
| 4,741,414 | 5/1988 | Claassen | 254/122 |

FOREIGN PATENT DOCUMENTS

| | | | |
|---|---|---|---|
| 2427795 | 12/1975 | Fed. Rep. of Germany | 254/122 |
| 2199014 | 6/1988 | United Kingdom | 254/122 |

*Primary Examiner*—J. J. Hartman

*Attorney, Agent, or Firm*—William L. Chapin

[57] ABSTRACT

A hydraulic lift mechanism for raising and lowering heavy loads such as a camper shell above the cargo area of a truck includes a generally planar U-shaped lower base frame attachable to the truck and a substantially identical plan-view shape upper load support frame for attachment to the camper shell or other load. Two identical X-shaped scissors jack-like, lifting structures comprised of two crossbeam members pivotably joined to one another at their centers, and pivotably joined at their forward ends to vertically aligned positions in an upper and lower side frame member, are spread apart by a hydraulic powered cylinder pivotably fastened at one end to a side rail of the base frame and pivotably fastened at the other end to a crossarm, to raise the load support platform. A pivotable X-shaped front frame transversely disposed to the side X-frames is vertically disposed between the front frame members of the base frame and the load support frame, the geometry of the front X-frame being such as to assure that the load support frame remains parallel to the base frame in spite of imbalanced loads or imbalanced actuating power delivered by the two hydraulic cylinders.

9 Claims, 5 Drawing Sheets

A
20
34
32
31
33
93
95
94
58
B
40R
40L
22
24
23
2
2
C
D
21

31
32
20
22
33
23
4
4
95
94
93
24
34
21
107

40L, 40R
48
72
71
70
53
46
44
45
42
61
33
29
63
65
106
52
62
87
84
86
85
69
67, 68
50
43
41
64
66
64
75
74
77
80
84
83
51
49
76
23
29
60
81
58
59
57
47
28

40L, 40R
44
53, 56
45
41
106
69
52, 55
84
81
85
51, 54
28
26
77
79
76
80
29
23
27
58

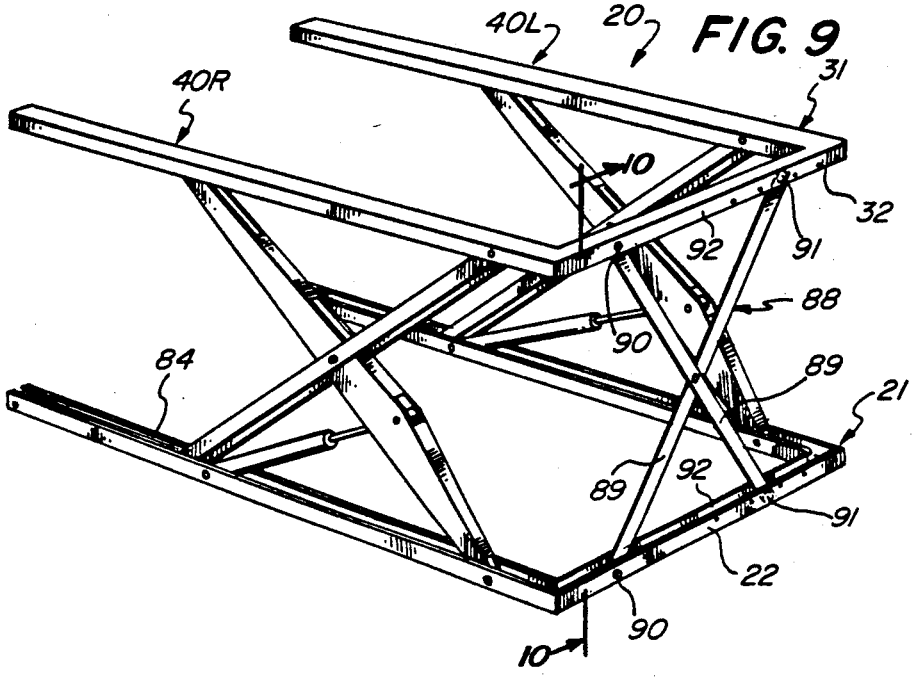
FIG. 9
FIG. 10
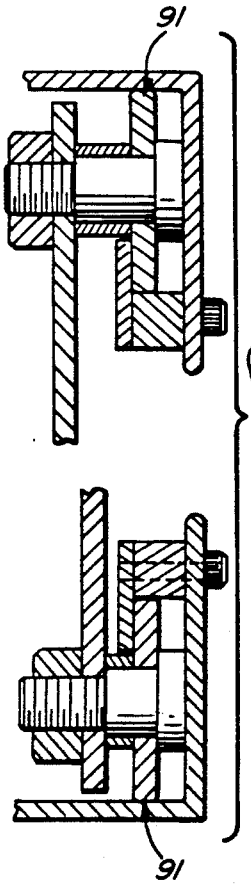
FIG. 11
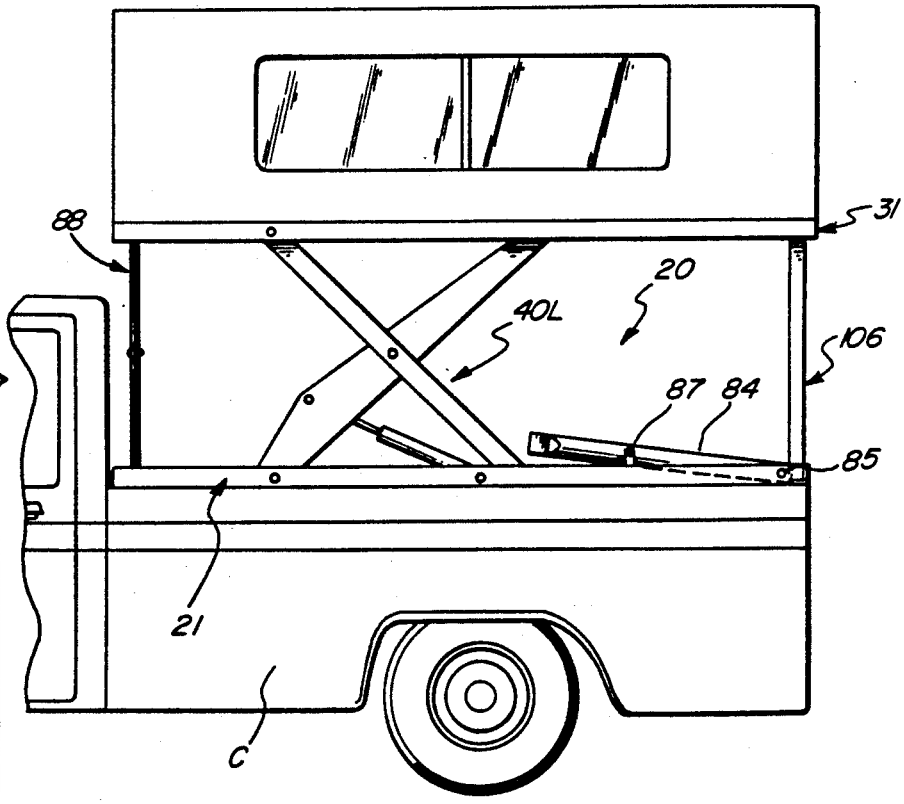

HYDRAULIC LIFT MECHANISM FOR CAMPER SHELLS

BACKGROUND OF THE INVENTION

1. Field of the Invention

This invention relates to mechanisms for raising heavy loads upwards from the cargo bed of a truck, using actuators operated by hydraulic power, or similar force-producing means. More particularly, the invention relates to a hydraulic lift mechanism which may be used to raise heavy loads such as a camper shell, tool compartment box or the like, above the bed of a truck to allow access to the truck bed, and lower the lifted portion to a low profile position as desired.

2. Description of Background Art

Pickup trucks, and to a lesser extent, small flatbed trucks, are used extensively as recreational vehicles. Such vehicles are often modified by the installation of an enclosure installed in the cargo area of the truck, the enclosure covering sleeping, cooking, toilet facilities and the like. The enclosures are commonly called camper shells, the name deriving from the intended use of the vehicle and the shape of the enclosure, which is usually that of an elongated, inverted box or shell.

When a vehicle equipped with a camper shell is in transit, it is desirable to have the vertical extension of the shell above the bed of the truck at a minimum. Minimum extension affords minimum wind resistance. Excessive wind resistance presented by high-profile camper shells can substantially reduce the gas mileage and operating efficiency of vehicles so equipped. Also, the wind resistance afforded by high profile camper shells can make a vehicle dangerously unstable in high cross winds.

From the comments made above, it is evident that low-profile camper shells are desirable when the vehicle equipped with the camper shell is in transit. However, when the vehicle has reached an intended destination such as a camp site, it would be desirable to have sufficient vertical clearance in the space between the camper shell roof and the bed of the truck on which the shell is mounted to permit adults to walk comfortably under the camper shell, without having to stoop. Thus, it would be desirable to have a camper shell which may be raised from a low-profile transit position to a higher clearance use position at a camp site, and readily returned to the low-profile position when departing from the camp site.

In apparent recognition of the desirability of having an extensible roof for the living quarters of recreational vehicles, a number of patents disclose such apparatus. These include the following U.S. Pat. Nos.:

Borskey, 3,582,130, June 1, 1971, Vehicle With Retractable and Extensible Roof Assembly.

Borskey, 3,770,314, Nov. 6, 1973, Vehicle With Retractable and Extensible Roof Assembly.

Gogush, 3,924,889, Dec. 9, 1975, Elevating Mechanism For The Roof Or Tops Of Vans And The Like.

McIntosh, 4,603,901, Aug. 5, 1980, Liftable Top For Pickup Trucks. and

German patent 2,840,487, Weinsberg, Mar. 27, 1980, Elevating Roof Drive Mechanism For Motor Carava.

U.S. Pat. Nos. disclosing the use of scissors jack-like lifting mechanisms include:

Traficant, 3,891,108, June 24, 1975, High Lift Mechanism.

Luebke, 4,092,011, May 30, 1978, Lift Mechanism For A Truck.

Oswald, 4,526,344, July 2, 1985, Auxiliary Lift Adapter.

Tominaga, 4,556,198, Dec. 3, 1985, Height Adjusting Lifter For Hospital Bed.

The present invention was conceived of to provide a lift mechanism for camper shells which can be readily attached to the bed or cargo box of a flat bed or pick-up truck without obstructing any useable space within the shell, whether the shell is in an elevated, use position or a lowered, transit position.

OBJECTS OF THE INVENTION

An object of the present invention is to provide a powered lift mechanism for attachment to the cargo area of a truck which may be used to raise and lower a camper shell, tool box, parts or inventory compartment box, pipe rack or similar relatively heavy load above the bed of the truck.

Another object of the invention is to provide a powered lift mechanism for trucks which maintains the base of the lifted structure parallel to the bed of the truck during the entire ascent and descent of the lifted structure.

Another object of the invention is to provide a powered lift mechanism for trucks which employs a linear power actuator.

Another object of the invention is to provide a lift mechanism for trucks which includes a simple, fail-safe means for preventing inadvertent descent of the lifted structure.

Another object of the invention is to provide a lift mechanism for trucks which does not obstruct any useable space between the lifted structure and the bed of the truck, whether the lifted structure is in a raised or lowered position.

Another object of the invention is to provide a lift mechanism for trucks which in its elevated position above the cargo area of the truck provides the driver with a substantially unobstructed rearward view.

Another object of the invention is to provide a lift mechanism for trucks in which the components of the lifting mechanism are substantially completely concealed and protected from the weather with the lifted structure in its lowered position.

Another object of the invention is to provide a lift mechanism for trucks which, in it elevated position, provides access to the cargo area of the truck from front, rear, left and right sides.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention reasonably inferrable from the description contained herein be included within the scope of the invention as defined by the appended claims.

SUMMARY OF THE INVENTION

Briefly stated, the present invention comprehends a powered lifting mechanism for raising and lowering relatively heavy structures such as a camper shell over the cargo area of a truck. A main embodiment of the invention includes a lower base frame constructed of straight, elongated U-cross-section channel members having their open sides facing upwards and joined together to form in plan view a C-shaped structure which lies over the front, left and right sides, respectively, of the cargo box of a pickup truck. An upper, load support frame which is the mirror image of the lower frame member, with the open sides of its channel members facing downwards, overlies the base frame.

A separate X-shaped, scissors jack-like lifting mechanism extends between the upper and lower channel members of both the left and right sides of the upper and lower frames. Each of the two X-shaped scissors jack-like lifting mechanisms is made up of two elongated crossarms pivotably joined to one another. The separation of the crossarms is controlled by a separate hydraulic power cylinder extending between each side base frame member and a crossarm to raise or lower the upper frame.

The lifting mechanism according to the present invention includes a third X-frame comprised of two crossarms pivotably joined to one another. The third X-frame is slidably contained within the upper and lower channels of the upper and lower front frame members, to ensure that both the left and right side frame members are raised and lowered the same distance, ensuring that the lifted structure always remains level, even if the hydraulic power cylinders exert different lifting forces.

BRIEF DESCRIPTION OF THE DRAWINGS

FIG. 9 is a front perspective view of the mechanism of FIG. 1, showing the mechanism in a fully extended position.

FIG. 10 is a fragmentary side sectional view of a front X-frame forming part of the mechanism of FIG. 9 generally indicated by line 10—10 of that Figure, but showing the mechanism in a more fully retracted position, similar to that of FIG. 6.

FIG. 11 is a side view of the mechanism of FIG. 1 in a fully extended position, showing the front end of a safety beam forming part of the mechanism propped up on its pivotable support leg to permit the mechanism to be lowered to its retracted position, and showing a safety column in its upward, operative position.

DETAILED DESCRIPTION OF THE INVENTION

Figure 1:
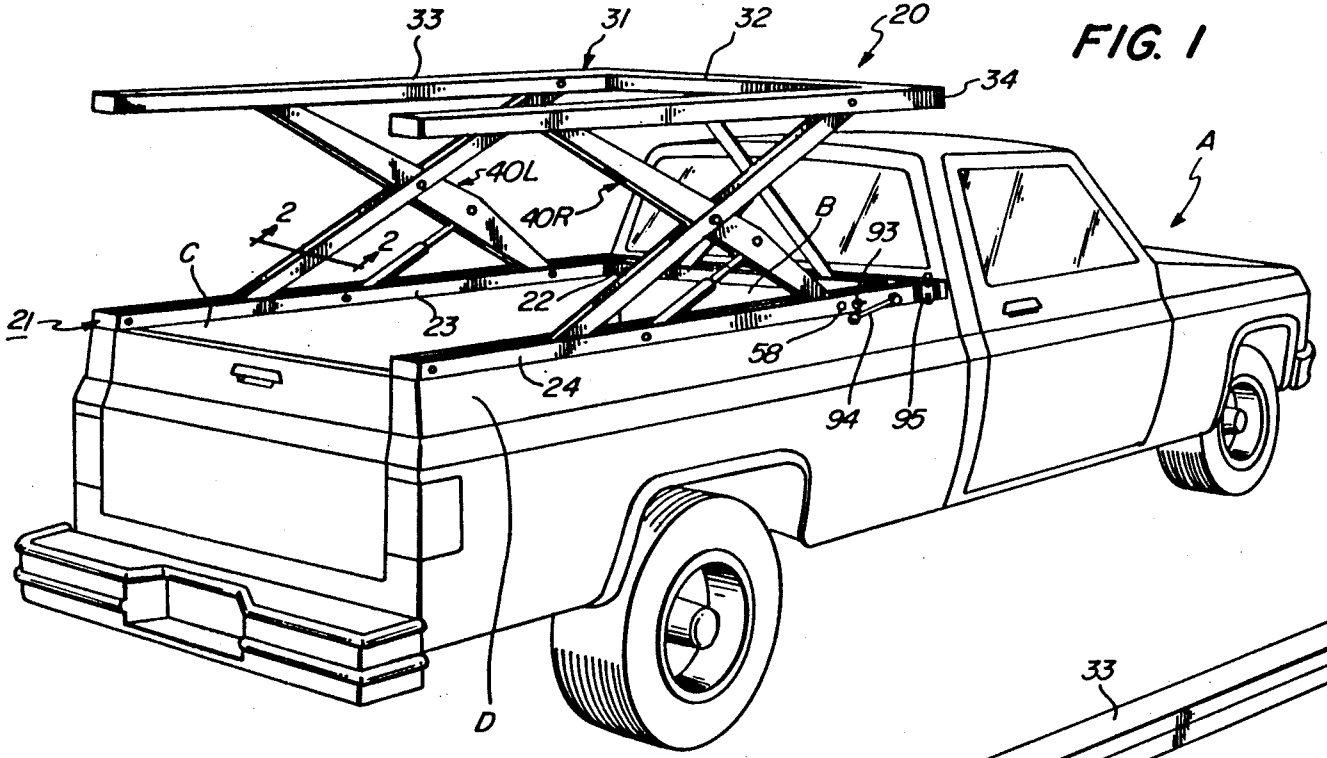
FIG. 1 is a perspective view of the hydraulic lift mechanism for camper shells according to the present invention, showing the mechanism attached to the top of the cargo box of a pickup truck.

Referring now to FIGS. 1 through 11, a hydraulic lift mechanism 20 for camper shells according to the present invention is shown.

As shown in FIGS. 1 through 5, the hydraulic lift mechanism 20 according to the present invention includes a base frame 21 adapted to fasten to the upper edge of the peripheral wall of a pickup truck or other truck. The base frame 21 has in plan view a U-shape, formed of a straight front member 22 joined perpendicularly at its outer lateral edges to longer, equal length left and right side members 23 and 24, respectively. Base frame members 22, 23 and 24 all lie in a common plane. The width of the base frame 21 is of the proper value to span the width of the cargo area of a truck to which the frame is to be attached. Left and right side members 23 and 24, which extend perpendicularly backwards from the outer lateral ends of front frame member 22, are of an equal length of the proper value to span the length of the cargo area of a truck to which the frame is to be attached.

Figure 3:
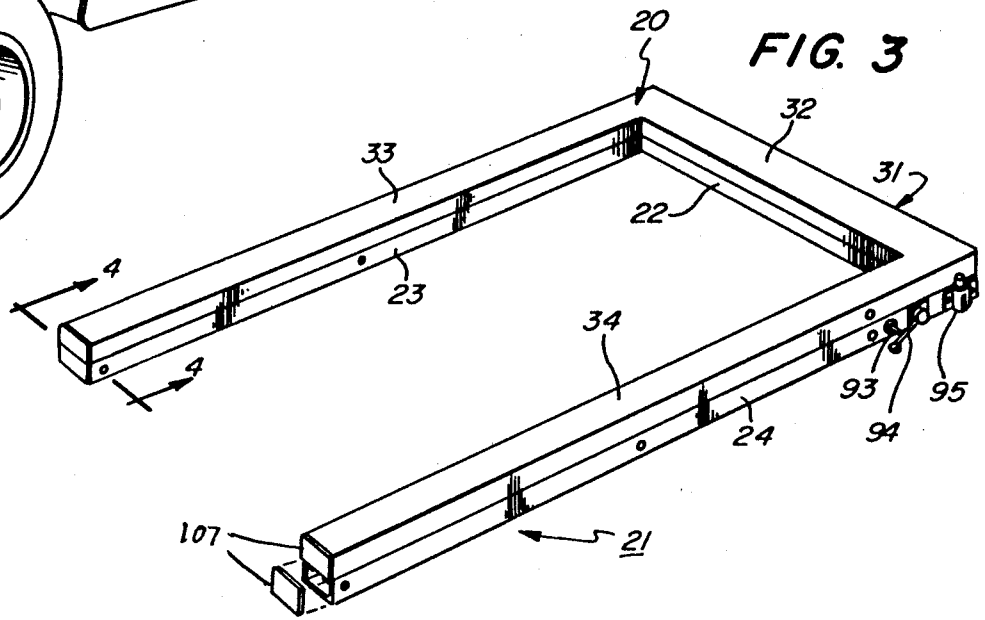
FIG. 3 is an upper perspective view of the mechanism of FIG. 1, showing the mechanism in a fully retracted or lowered position.
Figure 4:
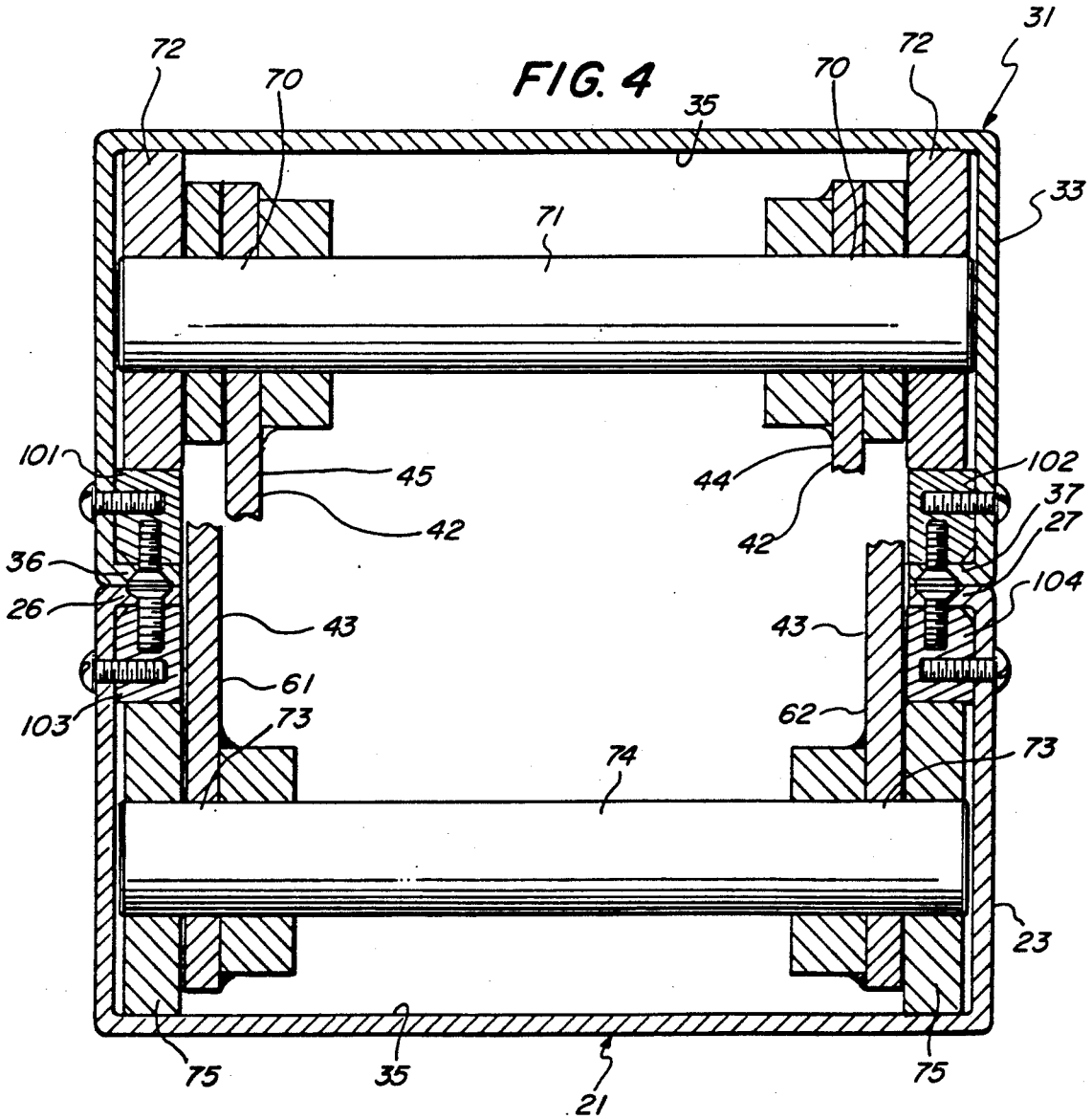
FIG. 4 is a fragmentary rear elevation view of a part of the mechanism of FIG. 3 generally indicated by line 4—4 of that Figure.

As may be seen best by referring to FIGS. 3 and 4, members 22, 23 and 24 comprising base frame 21 are preferably each fabricated from elongated steel channel stock 25 having a U-shaped transverse cross-sectional shape. Preferably, one side wall of channel stock 25 is bent inwards perpendicularly to form an elongated left flange 26. Similarly, the opposite side wall of channel stock 25 is bent inwards perpendicularly to form an elongated right flange 27, whose upper surface lies in the same horizontal plane as left flange 26, thereby forming a common horizontal seating surface therewith.

As shown in FIGS. 1 through 6, hydraulic lift mechanism 20 also includes an upper load support frame 31. Upper load support frame 31 is preferably a structure which is the mirror image through a horizontal plane of base frame 21, permitting a single fabrication jig to manufacture both base frames and load support frames as identical parts. Thus constructed, upper load support frame 31 comprises a front member 32, and left and right side members 33 and 34 extending perpendicularly backwards from opposite lateral ends of the front member. Load support frame 31 is preferably fabricated from the same steel U-cross section channel stock 25 as the base frame 21.

As shown in FIGS. 3 and 4, the open side of the channel stock 25 of which upper load support frame 31 is fabricated faces downwards, into the upwardly open side of base frame 21. Also as shown in FIG. 4, left and right perpendicularly inwardly extending lower flanges 36 and 37 are formed in the side walls of channel section 25 of which upper load support frame 31 is fabricated. Flanges 36 and 37 of upper load support frame 31 rest on flanges 26 and 27 of base frame 21, with the hydraulic lift mechanism 20 in a fully retracted position as shown in FIGS. 3 and 4.

As stated previously, the base frame 21 of the hydraulic lift mechanism 20 according to the present invention is adapted to fasten to the cargo compartment of a truck. In FIGS. 1 through 6, the base frame 21 is shown fastened to the upper edge surfaces of three walls of the cargo compartment of a pickup truck A. Front frame member 22 of base frame 21 overlies the front wall B of the pickup truck cargo compartment, while left base frame member 23 overlies left wall C of the cargo compartment, and right base frame member 24 overlies right side wall D of the cargo compartment.

The upper load support frame 31 of hydraulic lift mechanism 20 may be fastened to the base of a load which it is desired to raise and lower above the bed of a truck. As shown in FIGS. 1 through 6, load support frame 31 is attached to the base of a camper shell E located above the bed of a pickup truck A. The structure and operation of those components of the hydraulic lift mechanism 20 which effect the extension and retraction of the upper load support frame 31 with respect to the base frame 21 will now be described.

Figure 7:
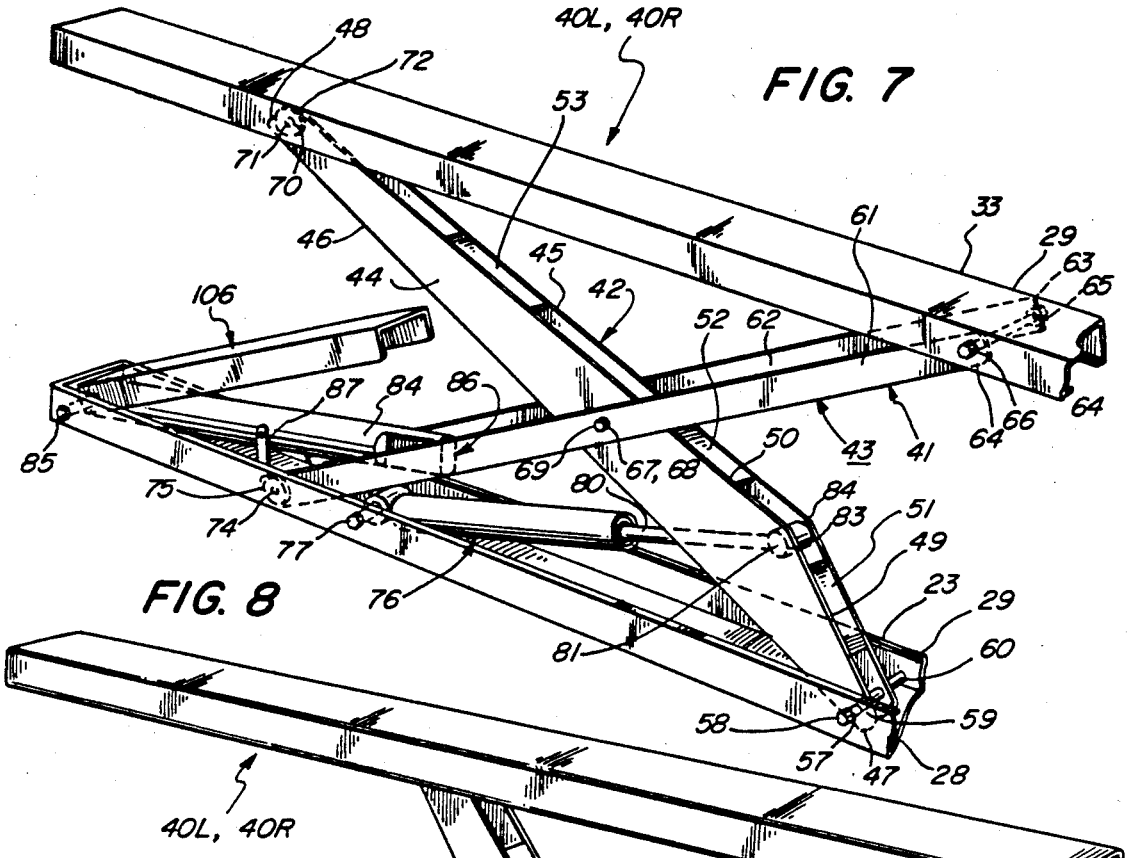
FIG. 7 is a fragmentary upper perspective view of the mechanism of FIG. 1, showing a hydraulic lifting structure forming part of the mechanism.

Referring now primarily to FIGS. 1 and 7, the apparatus for lifting upper load support frame 31 relative to base frame 21 of hydraulic lift mechanism 20 may be seen to include two identical hydraulic lifting structures positioned on left and right sides of the lift mechanism. Since the two hydraulic lifting structures are identical in structure and function, only one will be described. In the accompanying Figures, the elements of the left and right hydraulic lifting structures are designated by "L" and "R" suffix letters, respectively.

As shown in FIGS. 1 and 7, each of the two hydraulic lifting structures 40L and 40R includes an X-shaped side frame 41 having two elongated, generally straight structural members 42 and 43 which are pivotable in a vertical plane with respect to one another. The ends of structural members 42 and 43 are positioned within the channel openings of the side members of the base frame 21 and upper load support frame 31.

Figure 8:
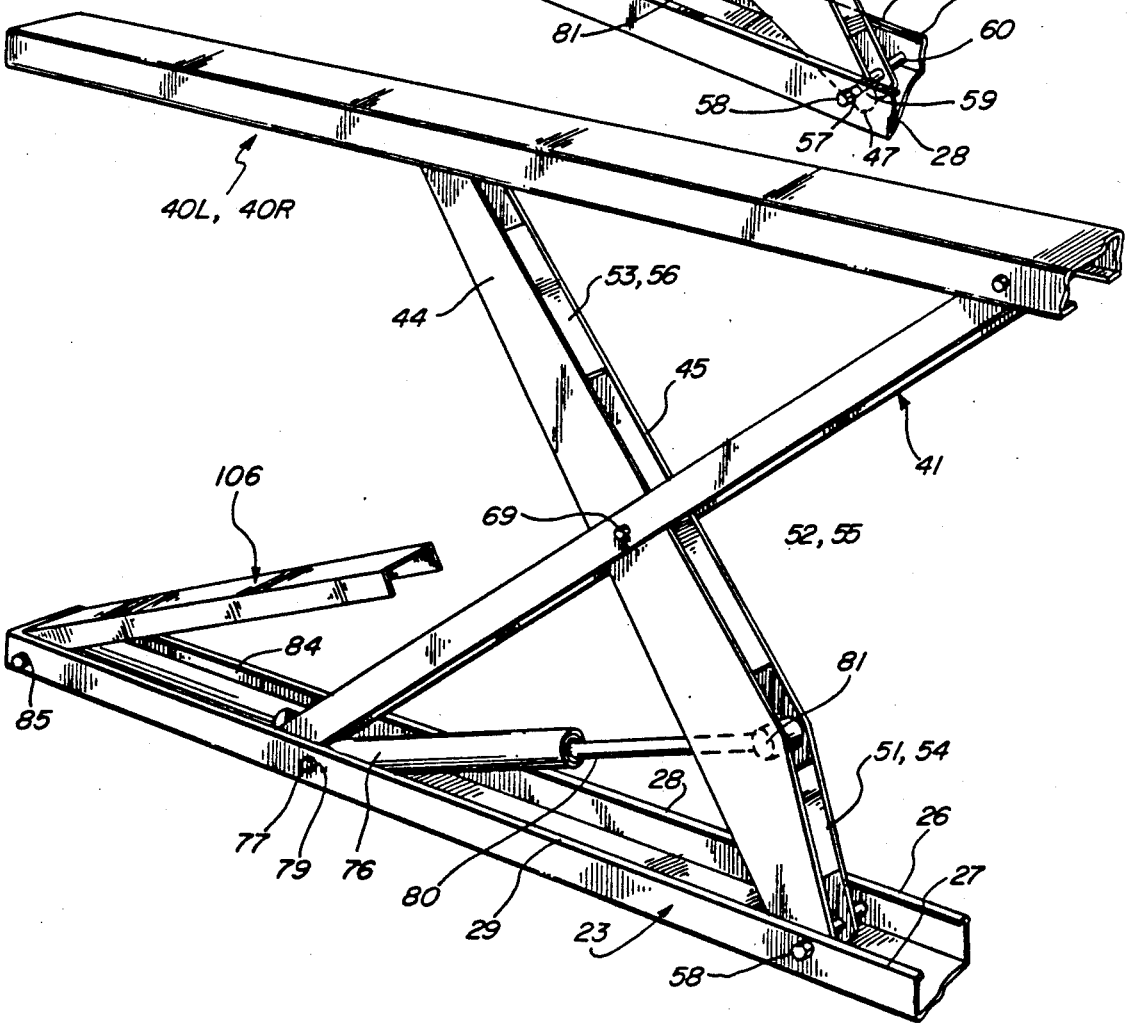
FIG. 8 is a fragmentary upper perspective view of the mechanism of FIG. 1, showing the mechanism extended almost to its upper limit of travel, and showing the front end of a safety beam forming part of the mechanism about to fall into locking position.

As may be seen best by referring to FIGS. 1, 7 and 8, the X-shaped side frame 41 of each of the two hydraulic lifting structures includes an inner beam member 42 fabricated from two steel plates 44 and 45. Plates 44 and 45 are cut identically, each plate having an elongated straight bottom edge wall 46 and short front and rear edge walls 47 and 48, respectively, extending perpendicularly upwards from the bottom edge wall. A short, straight top edge wall 49 extends backwards and upwards at a slight angle from the top of front edge wall 47. A long straight top edge wall 50 joins the short top edge wall and extends backwards and down wards at a slight angle to terminate at the top of rear edge wall 48. Thus, in plan view, inner and outer plates 44 and 45 of inner beam member 42 each has the shape of an elongated trapezoid.

As may be seen best by referring to FIGS. 7 and 8, longitudinally spaced rectangular flanges 51, 52, and 53 extend perpendicularly outwards from the upper edge walls of inner plate 44 of inner beam member 42. Similarly, longitudinally spaced rectangular flanges 54, 55, and 56 extend perpendicularly inwards from the upper edge wall of outer plate 44 of inner beam member 42. Flanges 54, 55, and 56 are identical in size, shape and location to flanges 51, 52, and 53. Thus, inner plate 44 and outer plate 45 of inner beam member 42 may be placed side by side in parallel alignment, with each flange of the inner plate congruently adjacent the corresponding flange of the lower plate, spacing the two plates apart to form a modified "box beam" or channel having an open bottom. As shown in FIG. 8, the flanges of inner plate 44 underlie the corresponding flanges of outer plate 45.

As shown in FIGS. 7 and 8, the inner plate 44 and outer plate 45 comprising inner beam member 42 are each provided with a hole 57 through the thickness dimension of the plates, near the intersection of the bottom edge walls 46 of the plates with the front edge walls 47. Front holes 57 through plates 44 and 45 are provided to receive a front pivot pin 58, which extends through registered holes 59 and 60 through the outer and inner side walls 28 and 29, respectively, of a side member 22 or 23 of base frame 21. The pivot pin 58 is secured at its opposite lateral ends to side walls 28 and 29 of a side member 22 and 23 of base frame 21. Sufficient clearance is provided between the outer surfaces of sides 44 and 45 of inner beam 42 and the inner surfaces of side walls 28 and 29 to permit free pivotable motion in a vertical plane of the inner beam 42 with respect to the base frame 21.

As may be seen best by referring to FIGS. 1, 2 and 7–9, inner beam 42 is sandwiched between two identical outer and inner elongated rectangular plates 61 and 62 comprising outer member 43 of X-shaped side frame 41. Plates 61 and 62 are each provided with a through hole 63 near the front short lateral edge wall of the plates. Holes 63 through plates 61 and 62 are used to pivotably fasten the front ends of the plates to a side member 33 or 34 of upper load support frame 31. Registered holes 64 and 65 are provided through the thickness dimension of outer and inner side walls 28 and 29 of an upper load support side frame member 33 or 34. A pivot pin 66 extends through holes 64 and 65 of inner and outer side walls 28 and 29 of the upper load support frame side frame member 33 or 34, and is secured within the side frame member. The diameter of holes 63 through outer plate 61 and inner plate 62 of outer member 43 is sufficiently greater than the diameter of the pivot pin to permit the plates to pivot freely in a vertical plane about the pivot pin. Sufficient clearance is provided between the outer parallel wall surfaces of plates 61 and 62 and the inner wall surface of side walls 28 and 29 of an upper load support side frame member 33 or 34 to permit free pivotable motion of the outer beam 43 with respect to the upper load support frame 31.

Located approximately midway between the front and rear edge walls of plates 44 and 45 of inner beam 42 of side X-frame 41 is a center pivot hole 67 extending through the thickness dimension of the plates. Similarly, a center pivot pin hole 68 extends through the thickness dimension of plates 61 and 62 of outer beam 43 of side X-frame 41, that hole being located approximately midway between the front and rear edge walls of the plates. A pivot pin 69A extends through registered hole 68 of outer plate 61 of outer double beam 43, and hole 67 of outer plate 45 of inner double beam 42, and is secured against longitudinal movement therethrough. Similarly, a pivot pin 69B extends through hole 68 of inner plate 62 of outer double beam 43, and registered hole 67 through inner plate 44 of inner double beam 42. Pivot pins 69A and 69B permit free pivotable motion in a vertical plane of inner beam member 42 of side X-frame 41 relative to the outer beam 43 of the side X-frame, while providing a clear space between facing plates 44 and 45 of inner double beam 42, for a purpose to be described later.

The inner plate 44 and outer plate 45 of inner beam member 42 are also each provided with a third hole 70 through the thickness dimension of the plates. Hole 70 is located near the intersection of the long upper edge wall 50 of plates 44 or 45 with the rear edge wall 48. An axle 71 extending through holes 70 in plates 44 and 45 supports on opposite ends of the axle a pair of roller wheels 72. Roller wheels 72 are provided to support the lower surface of the inverted bottom wall 35 of a left or right side member 33 or 34 of upper load support frame 31, while permitting free longitudinal motion of the upper, rear end of inner beam member 42 relative to the upper load support frame.

As may be seen best by referring to FIG. 4, elongated rectangular cross-section rails 101 and 102 fastened above flanges 36 and 37 of left and right side members 33 and 34 maintain roller wheels 72 in contact with the inverted bottom wall 35 of the side member, preventing vertical movement of the side member with respect to the roller.

Similarly, the plates 61 and 62 comprising outer beam member 43 of a side X-frame 41 are each provided with a third hole 73 through the thickness dimension of the plates. Hole 73 is located near the intersection of the upper edge wall of plate 61 or 62 with the rear edge wall of the plate. An axle 74 extending through holes 73 in plates 61 and 62 supports on opposite ends of the axle a pair of roller wheels 75. Roller wheels 75 are provided to permit the bottom wall 35 of a left or right side member 23 or 24 of base frame 21 to support the rear, lower end of outer beam member 43, while permitting free longitudinal motion of that end of the beam member relative to the base frame.

As may be seen best by referring to FIG. 4, elongated rectangular cross-section rails 103 and 104 fastened underneath flanges 26 and 27 of left and right side members 23 and 24 of base frame 21 maintain roller wheels 75 in contact with the bottom wall 35 of the side members, preventing vertical movement of the roller with respect to the side members.

As should be apparent from the foregoing description of the hydraulic lifting structure 40, that structure provides for secure support of upper load support frame 31 by base frame 21, yet permits free vertical movement of the load support frame upwards and downwards with respect to the base frame, without relative horizontal translational movement between the two frames. The mechanism for providing powered lifting of the upper load support frame 31 will now be described.

Referring now to FIGS. 1, 7, and 8, it may be seen that a hydraulic power actuator cylinder 76 is pivotably mounted at its base end by a pivot pin 77 extending through registered holes 78 and 79 in left and right side walls 28 and 29 of a side member 23 or 24 of base frame 21. Holes 78 and 79 are located rearward of the front lower pivot pin 58 of inner beam 42, and forward of the rear lower end of outer beam 43. The free end of a piston rod 80 extending outwards from the hydraulic cylinder 76 is pivotably connected to the inner beam 42 of X-shaped side frame 41.

The pivotable connection between hydraulic cylinder 76 and inner beam 42 is made by means of a pivot pin 81 disposed transversely to the piston rod 80 near its distal end, the pivot pin extending through holes 83 in inner plate 44 and outer plate 45 of inner member 42. Holes 83 through plates 44 and 45 of inner beam member 42 are located near the intersection of the short top edge wall 49 and long edge wall 50 of each plate. The longitudinal location of hole 83 in each plate 44 and 45 is approximately midway between the center line of the front pivot hole 57 about which the inner beam 42 comprised of the plates rotates relative to the base frame 31, and the center line of the center pivot hole 67 about which the outer beam 43 rotates relative to the inner beam.

Figure 2:
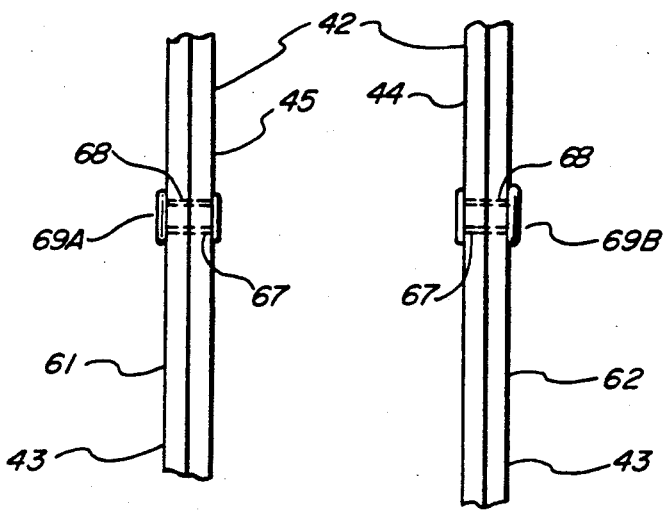
FIG. 2 is a fragmentary rear elevation view of a pivotable frame member joint forming a part of the mechanism of FIG. 1 generally indicated by line 2—2 of that Figure.

As may be seen best by referring to FIG. 7, the hydraulic cylinder 76 and piston rod 80 are of such a size and location as to permit lateral clearance between their outer lateral sides and the inner lateral side walls of plates 44 and 45 comprising inner beam 42. Thus, with the hydraulic lift mechanism 20 in a fully retracted position, i.e., with upper load support frame 31 resting on base frame 21, as shown in FIG. 1, the hydraulic cylinder 76 and piston rod 81 are fully enclosed within inner beam 42 and the side walls 28 and 29 of side member 23 or 24 of base frame 21. As shown in FIG. 2, the lateral clearance between pivot pins 69A and 69B of inner beam 42 permits the inner beam to nest over the hydraulic cylinder 76.

From the foregoing description of the hydraulic lifting structure 40 of the hydraulic lift mechanism 20 and reference to FIGS. 1 and 3, it should be evident that with piston rod 80 fully retracted within hydraulic power actuator cylinder 76, upper load support frame 31 is in its lowermost, retracted position, in contact with base frame 21.

When hydraulic pressure is applied to the inlet port of the hydraulic power actuator cylinder 76, its piston and attached piston rod 80 are forced longitudinally outwards with respect to the base of the cylinder. Outward movement of piston rod 80 forces inner beam 42, to which the end of the piston rod is pivotably attached, to move outwards relative to the base of the hydraulic cylinder 76. Since this base is pivotably attached to a side member 23 or 24 of base frame 21, and since the front, lower end of inner beam 42 is also pivotably attached to a side member of the base frame, outward extension of the piston rod 80 causes the inner beam to pivot upwards. This movement in turn causes the upper, rear end of the inner beam 42 to slide forward within a side member 33 or 34 of upper frame 31. Also, since outer beam 43 is pivotably connected at its midpoint to the midpoint of inner beam 42 via center pivot pins 69A and 69B, upward pivoting motion of the inner beam causes the outer beam to pivot counterclockwise about the pivot pin 66 joining the outer beam to a side member of upper load support frame 31. This pivotable motion in turn causes the lower, rear end of the outer beam 43 to move forward within a side member 23 or 24 of base frame 21. The roller wheels 75 rotatably attached to the rear end of outer beam 43 permit the rear end of the beam to move freely on the bottom wall 35 of a side member 23 or 24.

Figure 6:
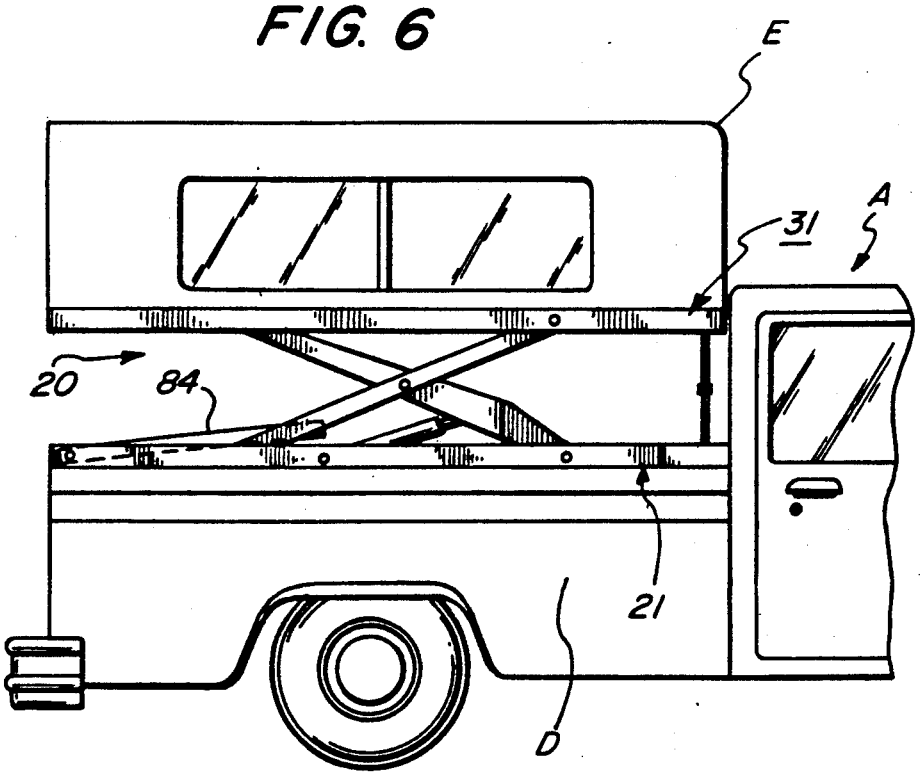
FIG. 6 is a side elevation view of the mechanism of FIG. 1, showing the mechanism in a partially extended position.

FIGS. 6 and 7 illustrate the configuration of hydraulic lift mechanism 20 in a partially extended position. As shown in FIGS. 6 and 7, the lift mechanism 20 includes a separate elongated straight safety beam member or bar 84 contained with the channel of both the left side member 23 and right side member 24 of base frame 21. Each beam 84 is attached near its rear end by a pivot pin 85 to the side walls 28 and 29 of a side member 23 or 24 of base frame 21, and lies in the channel between the side walls.

Figure 5:
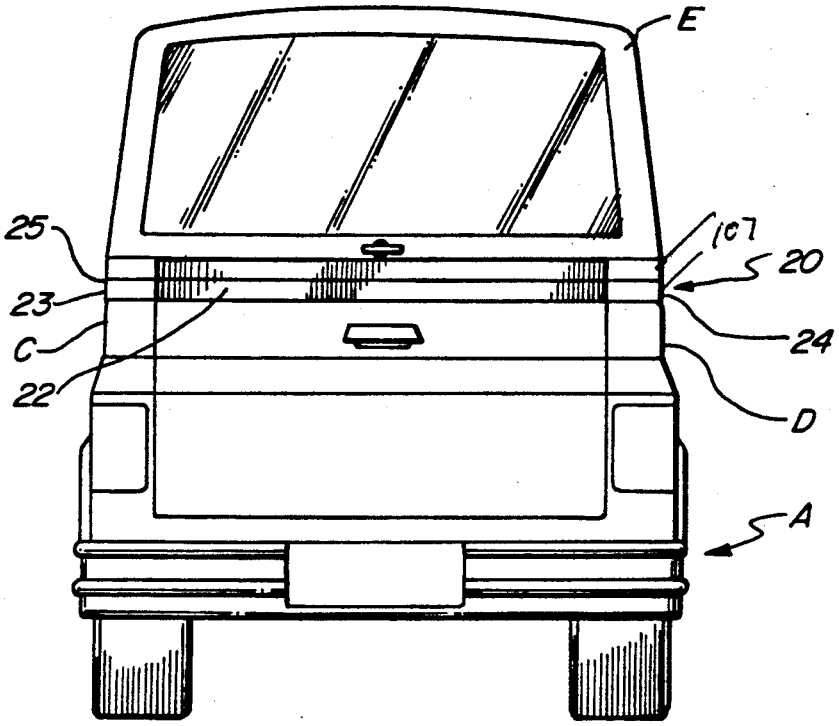
FIG. 5 is a rear elevation view of the mechanism of FIG. 1, showing the mechanism in a fully retracted position, and showing a camper shell mounted on the mechanism.

With the upper load support frame 31 in a fully retracted position, as shown in FIGS. 3 and 5, or partially extended, as shown in FIGS. 6 and 7, the front end of each safety beam 84 lies on top of the roller axle 74 supporting the rear end of outer beam 43. As the load support frame 31 is elevated by the hydraulic lifting structure 40, roller axle 74 moves forward within the side walls 28 and 29 of a side member 23 or 24 of base frame 21, relative to the forward end of a safety beam 84.

When the upper load support frame 31 has been elevated to nearly the upper limit of its travel, the front end of the safety beam 84 rests on roller axle 74, as shown in FIGS. 6 and 7. When the upper load support frame 31 is elevated slightly further, the front end of safety beam 84 falls under the force of gravity to contact the bottom wall 35 of the channel stock 25 forming a left or right side member 23 or 24 of the base frame 21. In this fully extended position, as shown in FIG. 8, the front transverse wall 86 of safety beam 84 blocks rearward movement of roller axle 74 and outer beam 43. Thus, accidental descent of the upper load support frame which might be caused by loss of hydraulic pressure, or other component failure, will be prevented by the action of the safety beam 84 in blocking rearward movement of outer beams 43.

When it is desired to retract upper load support frame 31, the forward ends of safety beams 84 are first raised to above the height of roller axle 74. This is accomplished by swinging a small support leg 87 pivotably attached to safety beam 84 at a longitudinal position intermediate its front and rear ends down into a vertical position, resting on the bottom wall 35 of side member 23 or 24. FIGS. 7 and 11 illustrate this position of support legs 87. Then, when the pressure in hydraulic power actuator cylinders 76 is relieved to permit upper load support frame 31 to descend under the force of gravity, roller axles 74 on the ends of outer beam members 43 will roll backward underneath the elevated forward ends of safety beams 84. When the rollers 75 contact support legs 87, the latter are pivoted backwards and upwards to permit the roller axles 74 to ride under the lower surface of the safety beams 84 all the way back to their rear-most position, where the upper load support frame 31 is fully retracted. When the upper load support frame 31 is next extended to its full height, safety beams 84 will once again be in a position to automatically fall behind roller axles 74 into a locking position.

FIGS. 9 and 10 illustrate a front vertical X-frame 88 positioned between the front member 22 of base frame 21 and the front member 32 of upper load support frame 31. Front X-frame 88 includes two identical elongated rectangular beams 89, one each of which is attached by a pivot bolt 90 to a separate vertically aligned position within lower front base frame member 22 and upper load support front frame member 23, respectively. The opposite end of each beam 89 is provided with a roller 91 constrained to roll within a transversely disposed channel 92 contained within the opposite side of the channel of frame members 22 and 32. The geometry of front X-frame 88 constrains both sides of upper load support frame 31 to remain at precisely the same height through the full travel of the frame from a fully retracted to a fully extended position, in spite of possible differences in forces exerted by the two hydraulic cylinders 76 on opposite sides of the frame, or differences in load weights supported by opposite sides of the load support frame.

Preferably, the hydraulic pressure pump, motor and control valves for the hydraulic actuator cylinders 76 are located within the channel of base frame 21. The electric switches for controlling up and down operation of the lift mechanism 20 are preferably located within the cab of the truck A. However, as shown in FIGS. 1 and 3, auxiliary controls for operating hydraulic power actuator cylinders 76 may be mounted exterior to the cab of the truck to which the hydraulic lift mechanism 20 is attached, permitting the mechanism to be operated by a person outside the truck cab. Thus, as shown in FIGS. 1 and 3, an electrical mode selector switch 93 is shown mounted on a side member 24 of base frame 21. Mode selector switch 93 is operatively interconnected with an electrical power source such as a vehicle battery, permitting the hydraulic pump-motor and control valves to be switched on when it is desired to operate the lift mechanism. Valve handle 94 adjacent switch 93 is operatively interconnected with the electrohydraulic pump system, permitting pressurized hydraulic fluid from a manual pump to be conducted into hydraulic power actuator cylinders 76 when it is desired to elevate the lift mechanism by means of a manually operated hydraulic pump, or out from the cylinders when it is desired to lower the lift mechanism.

FIGS. 1 and 3 also show the lever 95 of a manually operated hydraulic pump extending through side wall 29 of right base frame side member 23. A jack handle may be fitted to this lever 95 and pivoted up and down to manually raise and lower load support frame 31 by hydraulic pressure, in the event of failure of the electrohydraulic pump or its electrical power source.

As may be seen best by referring to FIGS. 6, 7 and 10, the hydraulic lift mechanism 20 includes a pair of safety support columns 106. Safety support columns 106 are made of rigid U-shaped steel channel stock. A separate column 106 is mounted to the rear of the left side base frame member 23 and right side base frame member 24. Each safety column 106 is fastened near its rear end by the pivot bolt 85 securing safety bar 84, so as to permit pivotable motion of the safety columns in a vertical plane. The outer width of safety column 106 is smaller than the lateral inner width of the channel stock 25 of which base frame member 23 and 24 are made, permitting each safety column to be contained conformally within the base frame channel when the columns are pivoted downwards into their horizontal, inactive positions. The channel opening of each safety column 106 is downward facing, and of sufficient inner width to permit the column to nest over a safety bar 84 with both resting in their horizontal positions.

When upper load support frame 31 is in its fully elevated position, as shown in FIG. 11, safety columns 106 may be pivoted into vertical positions, spanning the vertical distance between base frame 21 and the upper load support frame 31. In this position, safety columns 106 will prevent the inadvertent descent of the upper load support frame, in spite of hydraulic system failure or even failure of structural elements of hydraulic lift mechanism 20.

As may be seen best by referring to FIGS. 3 and 5, rectangular end plates 107 are preferably used to seal the rear channel openings of channel stock 25 used to fabricate left and side base frame members 23 and 24, and left and right side upper load support frame members 33 and 34. Thus, with hydraulic lift mechanism 20 in its fully lowered, or retracted position, all of the working elements of the mechanism, as well as the cargo within the truck, are entirely sealed against weather. Further waterproofing and sealing against the environment can be effected by installing resilient gasket material between the bottom surfaces of base frame 24 and the respective surfaces of the truck to which the base frame is attached.

What is claimed is:

1. An apparatus for selectably raising and lowering loads above the cargo compartment of a vehicle comprising:

a. a first, base frame comprised of at least two symetrically positioned, right and left lower side beam members defining a generally flat lower surface for attachment to said vehicle, a generally flat upper surface parallel to said lower surface, and a transverse member joining said right and left lower side beam members, b. a second, load support frame comprised of two symetrically positioned, right and left side upper beam members defining an upper surface adapted to support loads, and a generally flat lower surface adapted to congruently overlie corresponding right and left side lower beam members, respectively, of said base platform in parallel alignment therewith, and a transverse member joining said right and left upper side beam members, c. a first, right side pivotable X-frame disposed vertically between said lower right side beam member of said base platform and said upper right side beam member of said load support frame, said right side X-frame comprising first and second elongated, generally straight crossarms of approximately the same length, said first elongated crossarm being vertically pivotably joined near one lateral edge to said lower right side beam member of said base frame, the opposite lateral end of said crossarm being horizontally slidably secured with respect to said load support frame, said second crossarm member being vertically pivotably joined near one lateral edge to said upper right side beam member of said load support frame in a vertically aligned position with said lower pivotable joint, the opposite lateral end of said crossarm being horizontally slidably secured with respect to said load support frame and said first and second first side X-frame crossarm members being pivotably joined near their mid points, and d. a first, right-side linear power actuator vertically pivotably joined at a first end to said lower right side beam member of said base platform, and vertically pivotably joined at a second end to one of said first side X-frame crossarm members, whereby longitudinal extension of said linear power actuator raises said upper right side beam member of said load support frame relative to said corresponding lower right side beam member of said base platform, and longitudinal retraction of said linear power actuator lowers said load support platform member relative to said base platform member.

e. a second, left-side pivotable X-frame identical in structure and function to said first, right side pivotable X-frame, and f. a second, left-side linear power actuator identical in structure and function to said first, right-side, linear power actuator, said side beam members which form said base frame being constructed of straight elongated U-shaped channel sections having an upward facing opening, transversely disposed end walls closing the ends of said channel sections and said side beam members forming said load support frame being elongated U-shaped channel sections substantially identical to said channel sections of said base frame, said load support frame beam members having a downward facing opening, said apparatus being thereby so constructed that when said load support frame rests on said base frame, substantially all of the operating elements of the lifting portion of the mechanism are enclosed within said channel sections.

2. The apparatus of claim 1 further including a third, transverse, pivotable X-frame vertically disposed between said transverse members of said base platform and said load support platform, the plane of said third X-frame being transversely disposed at equal angles to said first and second side X-frames, said third, transverse X-frame comprising first and second elongated, generally straight crossarms of approximately the same length, said first elongated crossarm being vertically pivotably joined near one lateral end to said base frame, the opposite lateral end of said crossarm being horizontally slidably secured with respect to said load support frame, and said second crossarm member being vertically pivotably joined near one lateral edge to said load support frame in a vertically aligned position with said lower pivotable joint, the opposite lateral end of said crossarm being horizontally slidably secured with respect to said base frame, and said first and second transverse X-frame crossarm members being pivotably joined near their mid points.

3. The apparatus of claim 2 wherein said second crossarm member of each of said right and left side pivotable X-frames is further defined as comprising two substantially identical elongated, rectangular plan view flat metal plates maintained in parallel disposition with respect to one another on either opposite sides of said first crossarm member, each of said plates being pivotably fastened by a separate pivot joint at its approximate mid point to an opposite side of said first crossarm member.

4. The apparatus of claim 3 wherein said first crossarm member of each of said right and left side pivotable X-frames is further defined as a channel-shaped beam having inner and outer generally flat and parallel inner and outer side walls and an elongated rectangular space therebetween.

5. The apparatus of claim 4 wherein said linear actuator is positioned laterally between said inner and outer sides of said channel-shaped first crossarm member, whereby said actuator may rest between said channel side walls with said upper load support frame lowered towards said base frame.

6. The apparatus of claim 1 wherein each of said ends of said pivotable X-frame crossarm members which is horizontally slidably attached to a side member is provided with a roller whose axle is perpendicularly disposed with respect to said crossarm member, and said side member is provided with a longitudinally disposed rectangular cross-section channel having a bottom wall surface adapted to rollably receive said roller, and said side member is provided with a longitudinally disposed, rail vertically confining said roller to ride on said bottom wall of said channel.

7. The apparatus of claim 6 further including safety stop means for limiting inadvertent rearward movement of those rollers attached to the lower ends of said second pivotable side X-frame crossarm members, thereby preventing inadvertent descent of said load support platform, said safety stop means comprising an elongated straight bar vertically pivotably fastened by pivot means at its rear end to a said base frame side member and disposed longitudinally within said channel formed therein, the forward end of said bar resting on the upper surface of said axle of said roller with said load support frame in a lowered or partially extended position, said bar being slightly shorter than the distance between said pivot means and said roller with said load support platform in a fully elevated position, such that the forward end of said bar drops under the force of gravity behind said roller axle when said load support frame is fully elevated, said bar having a front face which abuts and prevents rearward movement of said axle until said bar is pivoted upwards, thereby automatically deploying said safety stop means.

8. The apparatus of claim 7 further including safety blocking means for limiting inadvertent downward movement of said load support frame relative to said base frame, said safety blocking means comprising an elongated member vertically pivotably fastened to said apparatus and pivotable into a vertical position between said base frame and load support frame with said load support frame in an elevated position.

9. The apparatus of claim 8 wherein said safety blocking means is further defined as comprising a channel-shaped column vertically pivotably fastened at its rear end to a side base frame member, and nestable over said safety bar with both in their retracted, horizontal positions.

* * * * *